US011826609B2

(12) United States Patent
Lin et al.

(10) Patent No.: US 11,826,609 B2
(45) Date of Patent: Nov. 28, 2023

(54) REHABILITATION EQUIPMENT

(71) Applicant: HIWIN TECHNOLOGIES CORP., Taichung (TW)

(72) Inventors: Wen-Bin Lin, Taichung (TW); Ming-Hsu Mao, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 463 days.

(21) Appl. No.: 17/110,572

(22) Filed: Dec. 3, 2020

(65) Prior Publication Data

US 2021/0086027 A1 Mar. 25, 2021

Related U.S. Application Data

(63) Continuation-in-part of application No. 15/972,290, filed on May 7, 2018, now abandoned.

(51) Int. Cl.

| | |
|---|---|
| ***A63B 22/14*** | (2006.01) |
| ***A61H 1/02*** | (2006.01) |
| *A63B 22/00* | (2006.01) |

(52) U.S. Cl.

CPC ..... *A63B 22/14* (2013.01); *A61H 1/0237* (2013.01); *A61H 2201/1207* (2013.01);

(Continued)

(58) Field of Classification Search

CPC . A61H 1/00; A61H 1/005; A61H 1/02; A61H 1/0237; A61H 1/0255; A61H 1/0262; A61H 2001/0207; A61H 2001/0211; A61H 2203/0406; A61H 2201/164; A61H 2201/1671; A61H 2201/5061; A61H 2201/5071; A61H 2205/10; A61H 2205/106; A61H 2205/108;

(Continued)

(56) References Cited

U.S. PATENT DOCUMENTS

| | | | | |
|---|---|---|---|---|
| 2008/0234113 | A1* | 9/2008 | Einav | A61H 1/0237 482/142 |
| 2011/0021957 | A1* | 1/2011 | Shinomiya | A61H 1/0262 601/5 |
| 2014/0371640 | A1* | 12/2014 | Schorgendorfer | A61H 1/0266 601/35 |

FOREIGN PATENT DOCUMENTS

| | | | |
|---|---|---|---|
| CN | 201147303 Y | * | 11/2008 |
| CN | 106267773 A | * | 1/2017 |

(Continued)

OTHER PUBLICATIONS

A Search Report issued in counterpart Taiwanese application No. 106143526 dated Aug. 28, 2018.

*Primary Examiner* — Justine R Yu
*Assistant Examiner* — Benjamin M. Kusiak
(74) *Attorney, Agent, or Firm* — Birch, Stewart, Kolasch & Birch, LLP

(57) ABSTRACT

A rehabilitation equipment includes a left foot pedal, a right foot pedal, a left-pedal driving module to drive movement of the left foot pedal, and a right-pedal driving module to drive movement of the right foot pedal. The rehabilitation equipment measures torques output by the left-pedal driving module and the right-pedal driving module when a user is at a relaxing state and also when the user is at an exercising state to obtain information relating to forces voluntarily output by the left foot and the right foot of the user, and determines a force output condition of the left foot and the right foot of the user.

6 Claims, 11 Drawing Sheets

(52) U.S. Cl.
CPC ..... *A63B 2022/0038* (2013.01); *A63B 2208/0204* (2013.01); *A63B 2220/54* (2013.01)

(58) Field of Classification Search
CPC .... A61H 2230/62; A61H 3/00; A63B 23/035; A63B 23/03516; A63B 23/03525; A63B 23/03533; A63B 23/03541; A63B 23/04; A63B 23/0476; A63B 23/0482; A63B 23/0494; A63B 24/0003; A63B 24/0062; A63B 2024/0065; A63B 2024/0071; A63B 2208/02; A63B 2208/0204; A63B 2220/17; A63B 2250/51; A63B 2250/58
USPC ..... 601/23, 33–35, 5
See application file for complete search history.

(56) References Cited

FOREIGN PATENT DOCUMENTS

| | | | | |
|---|---|---|---|---|
| JP | 2005-334099 | A | 12/2005 | |
| TW | 201601801 | A | 1/2016 | |
| WO | WO 2017/081647 | A1 | 5/2017 | |
| WO | WO-2017081647 | A1 * | 5/2017 | ..... A61B 5/112 |

* cited by examiner

REHABILITATION EQUIPMENT

CROSS-REFERENCE TO RELATED APPLICATION

This application is a continuation-in-part (CIP) application of U.S. patent application Ser. No. 15/972,290, filed on May 7, 2018, the contents of which are incorporated herein by reference.

FIELD

The disclosure relates to a passive training equipment, and more particularly to a rehabilitation equipment.

BACKGROUND

Taiwanese Patent No. 1262092 discloses a system for adjusting a belt speed of an electric treadmill based on a time difference between electric-current loads generated by treading steps of the user on the belt, so at to cause the belt speed to approach the walking or running speed of the user.

However, a rehabilitation equipment is different from an ordinary training equipment such as a treadmill, and requires more information to assess the effectiveness of rehabilitation, and/or to motivate the user to perform voluntary movement during rehabilitation.

SUMMARY

Therefore, this disclosure provides a rehabilitation equipment that implements a method for assessing voluntary movement of a user during rehabilitation.

According to the disclosure, the rehabilitation equipment includes a left foot pedal for operation by a left foot of the user, a left-pedal driving module to drive movement of the left foot pedal for guiding the left foot of the user to take a step, a left-pedal measuring module mounted to the left-pedal driving module, a right foot pedal for operation by a right foot of the user, a right-pedal driving module to drive movement of the right foot pedal for guiding the right foot of the user to take a step, a right-pedal measuring module mounted to the right-pedal driving module, and a processing module electrically connected to the left-pedal measuring module and the right-pedal measuring module.

The method implemented by the rehabilitation equipment includes first to sixth steps. In the first step, the left-pedal measuring module and the right-pedal measuring module measure, during a first time period which has a length equaling that of a measuring cycle and in which both of the left foot of the user on the left foot pedal and the right foot of the user on the right foot pedal are at a relaxing state, a torque output by the left-pedal driving module to generate first left-pedal torque information corresponding to the first time period, and a torque output by the right-pedal driving module to generate first right-pedal torque information corresponding to the first time period. The first left-pedal torque information includes multiple sets of first-period left-pedal torque data respectively corresponding to a plurality of measuring points which are points in time defined within the measuring cycle, and the first right-pedal torque information includes multiple sets of first-period right-pedal torque data respectively corresponding to the measuring points. Each of the sets of the first-period left-pedal torque data includes a first-period left-pedal horizontal torque value and a first-period left-pedal vertical torque value, and each of the sets of the first-period right-pedal torque data includes a first-period right-pedal horizontal torque value and a first-period right-pedal vertical torque value. In the second step, the left-pedal measuring module and the right-pedal measuring module measure, during a second time period which has a length equaling that of the measuring cycle and in which both of the left foot of the user on the left foot pedal and the right foot of the user on the right foot pedal are at an exercising state, a torque output by the left-pedal driving module to generate second left-pedal torque information corresponding to the second time period, and a torque output by the right-pedal driving module to generate second right-pedal torque information corresponding to the second time period. The second left-pedal torque information includes multiple sets of second-period left-pedal torque data respectively corresponding to the measuring points, and the second right-pedal torque information includes multiple sets of second-period right-pedal torque data respectively corresponding to the measuring points. Each of the sets of the second-period left-pedal torque data includes a second-period left-pedal horizontal torque value and a second-period left-pedal vertical torque value, and each of the sets of the second-period right-pedal torque data includes a second-period right-pedal horizontal torque value and a second-period right-pedal vertical torque value. In the third step, the processing module determines a difference between the first left-pedal torque information and the second left-pedal torque information to generate left-foot force output information relating to a force output by the left foot of the user, and determines a difference between the first right-pedal torque information and the second right-pedal torque information to generate right-foot force output information relating to a force output by the right foot of the user. The left-foot force output information includes multiple sets of left-pedal torque difference data respectively corresponding to the measuring points, each of the sets of the left-pedal torque difference data relating to a difference between one of the second-period left-pedal torque data and one of the first-period left-pedal torque data that correspond to a respective same one of the measuring points. Each of the sets of the left-pedal torque difference data includes a left-pedal horizontal torque difference value which is a difference between the first-period left-pedal horizontal torque value of the corresponding one of the sets of the first-period left-pedal torque data and the second-period left-pedal horizontal torque value of the corresponding one of the sets of the second-period left-pedal torque data, and a left-pedal vertical torque difference value which is a difference between the first-period left-pedal vertical torque value of the corresponding one of the sets of the first-period left-pedal torque data and the second-period left-pedal vertical torque value of the corresponding one of the sets of the second-period left-pedal torque data. The right-foot force output information includes multiple sets of right-pedal torque difference data respectively corresponding to the measuring points. Each of the sets of the right-pedal torque difference data relates to a difference between one of the second-period right-pedal torque data and one of the first-period right-pedal torque data that correspond to a respective same one of the measuring points. Each of the right-pedal torque difference data includes a right-pedal horizontal torque difference value which is a difference between the first-period right-pedal horizontal torque value of the corresponding one of the sets of the first-period right-pedal torque data and the second-period right-pedal horizontal torque value of the corresponding one of the sets of the second-period right-pedal torque data, and a right-pedal vertical torque difference value which is a difference between the first-period right-pedal vertical torque value of the corresponding one of the sets of the first-period right-pedal torque data and the second-period right-pedal vertical torque value of the corresponding one of the sets of the second-period right-pedal torque data. In the fourth step, for each of the measuring points, the processing module corrects the left-pedal horizontal torque difference value that corresponds to the measuring point based on a predetermined horizontal torque reference value that corresponds to the measuring point to obtain a left-pedal horizontal torque correction value, corrects the left-pedal vertical torque difference value that corresponds to the measuring point based on a predetermined vertical torque reference value that corresponds to the measuring point to obtain a left-pedal vertical torque correction value, corrects the right-pedal horizontal torque difference value that corresponds to the measuring point based on the predetermined horizontal torque reference value that corresponds to the measuring point to obtain a right-pedal horizontal torque correction value, and corrects the right-pedal vertical torque difference value that corresponds to the measuring point based on the predetermined vertical torque reference value that corresponds to the measuring point to obtain a right-pedal vertical torque correction value. In the fifth step, the processing module calculates, for each of the measuring points, a left-pedal torque correction value based on the left-pedal horizontal torque correction value and the left-pedal vertical torque correction value that correspond to the measuring point, and a right-pedal torque correction value based on the right-pedal horizontal torque correction value and the right-pedal vertical torque correction value that correspond to the measuring point. In the sixth step, the processing module calculates, for each of the measuring points, a force output ratio based on the left-pedal torque correction value and the right-pedal torque correction value that correspond to the measuring point. For each of the measuring points, the force output ratio indicates one of a condition that the left foot of the user applied a force, a condition that the right foot of the user applied a force, and a condition that neither the left foot nor the right foot of the user applied a force.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
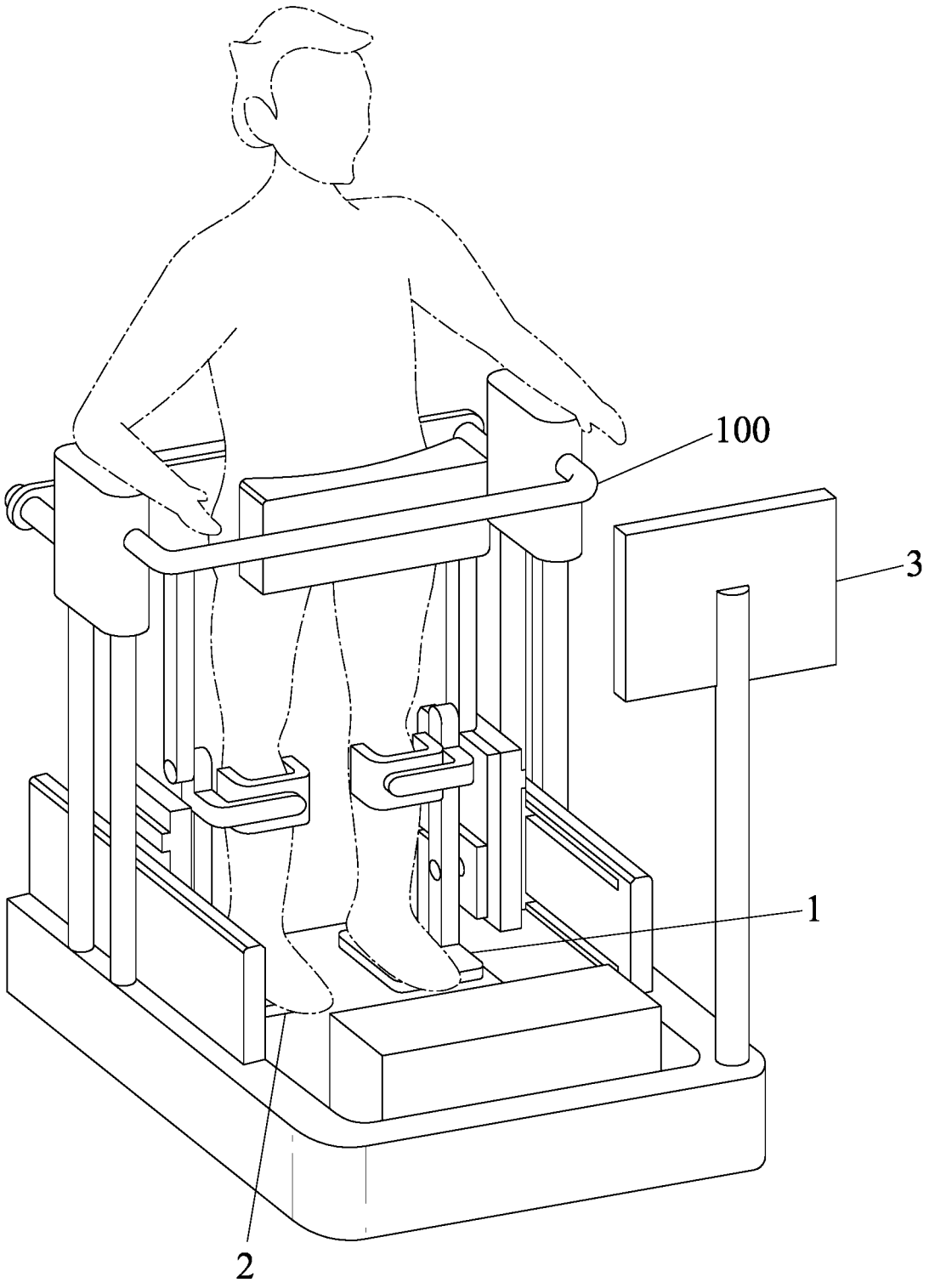
FIG. 1 is a perspective view illustrating an embodiment of a rehabilitation equipment used by a user according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
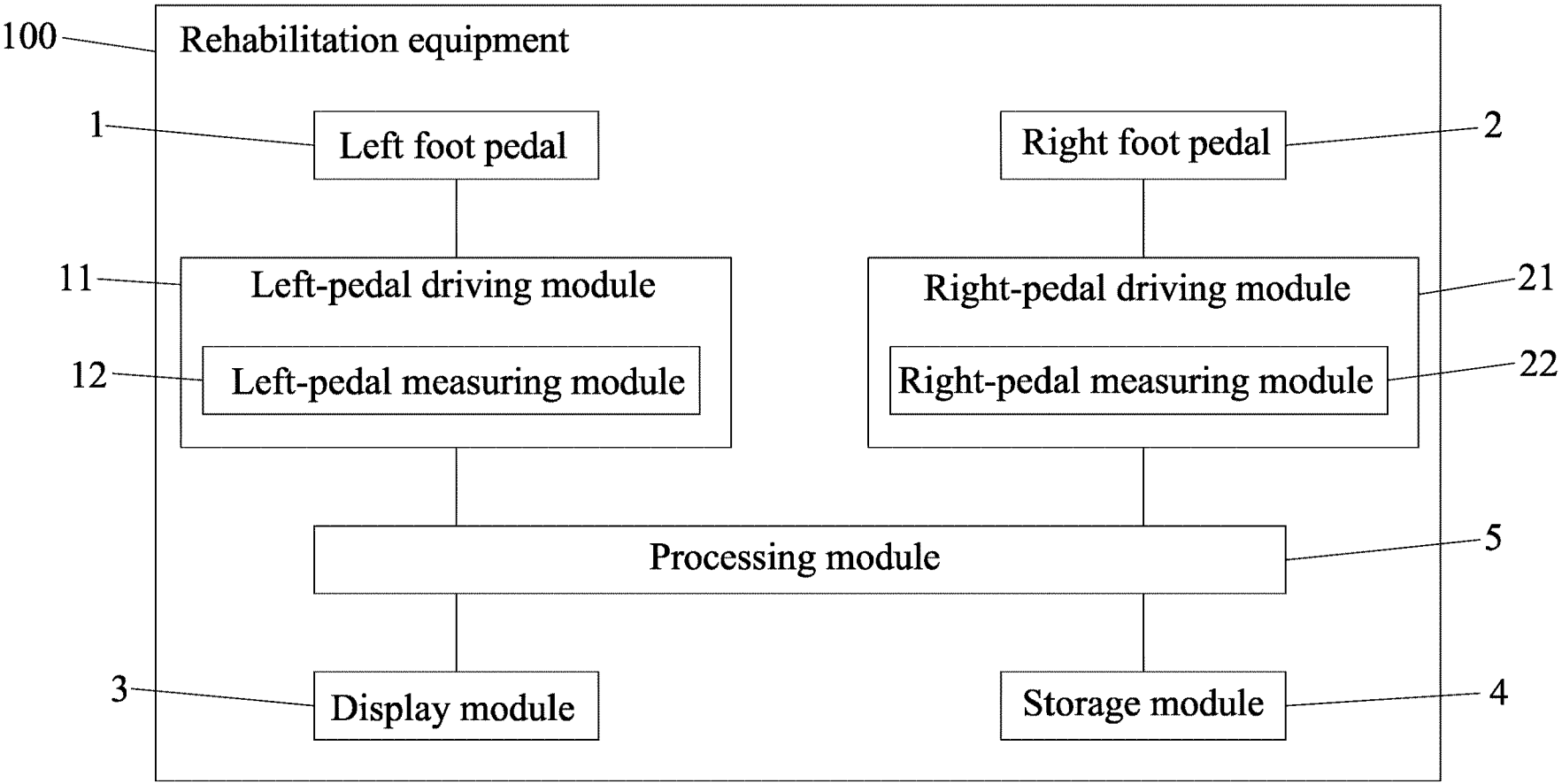
FIG. 2 is a block diagram illustrating the embodiment of the rehabilitation equipment according to this disclosure.

Referring to FIGS. 1 and 2, the embodiment of the rehabilitation equipment 100 according to this disclosure includes a left foot pedal 1 for operation by a left foot of a user, a left-pedal driving module 11 to drive movement of the left foot pedal 1 for guiding the left foot of the user to take a step, a left-pedal measuring module 12 mounted to the left-pedal driving module 11 and configured to measure a torque (rotational force) output by the left-pedal driving module 11 to drive movement of the left foot pedal 1, a right foot pedal 2 for operation by a right foot of the user, a right-pedal driving module 21 to drive movement of the right foot pedal 2 for guiding the right foot of the user to take a step, a right-pedal measuring module 22 mounted to the right-pedal driving module 21 and configured to measure a torque output by the right-pedal driving module 21 to drive movement of the right foot pedal 2, a display module 3 (e.g., a liquid crystal display device, a light emitting diode display device or the like), a storage module 4 (e.g., a read-only memory, a flash memory, a hard disk drive or the like), and a processing module 5 electrically connected to the left-pedal measuring module 12, the right-pedal measuring module 22, the display module 3 and the storage module 4. The processing module 5 may include a microcontroller or a controller such as, but not limited to, a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc., which are designed or programmed to perform operations as will be described hereinafter. The processing module 5 may be electrically connected to the left-pedal measuring module 12 and the right-pedal measuring module 22 either by physical wires or by wireless technologies, and this disclosure is not limited in this respect.

Figure 11:
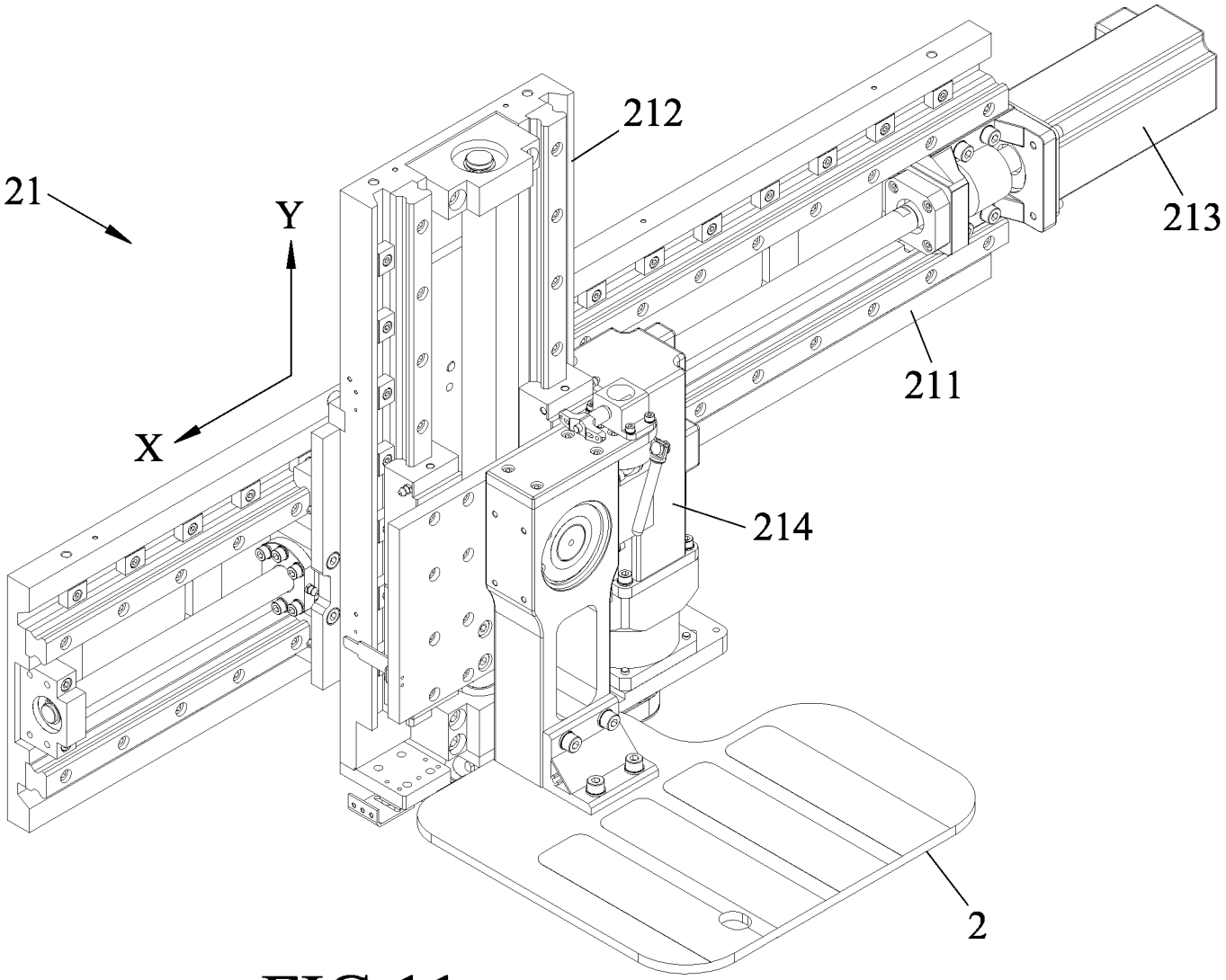
FIG. 11 is a perspective view illustrating an exemplary implementation of a right-pedal driving module of the embodiment of the rehabilitation equipment.

FIG. 11 illustrates an exemplary implementation of the right foot pedal 2 and the right-pedal driving module 21. The right-pedal driving module 21 includes a first platform 211 that has a first sliding rod extending in an X-axis direction, a second platform 212 that is slidably mounted to the first platform 211 and that has a second sliding rod extending in a Y-axis direction transverse to the X-axis direction, a first motor 213 that is configured to drive the second platform 212 to slide on the first sliding rod in the X-axis direction, and a second motor 214 that is configured to drive the right foot pedal 2, which is slidably mounted to the second platform 212, to slide on the second sliding rod in the Y-axis direction. The left foot pedal 1 and the left-pedal driving module 11 are structurally similar to the right foot pedal 2 and the right-pedal driving module 21, so details thereof are not repeated herein for the sake of brevity.

The rehabilitation equipment 100 is configured to assess voluntary movement of the user during rehabilitation, and the assessment includes calculating force output information relating to force output by the left foot and the right foot, calculating a force output ratio between the forces output by the left foot and the right foot, calculating overall step accuracy, and calculating a level of the voluntary movement of the user.

Figure 3:
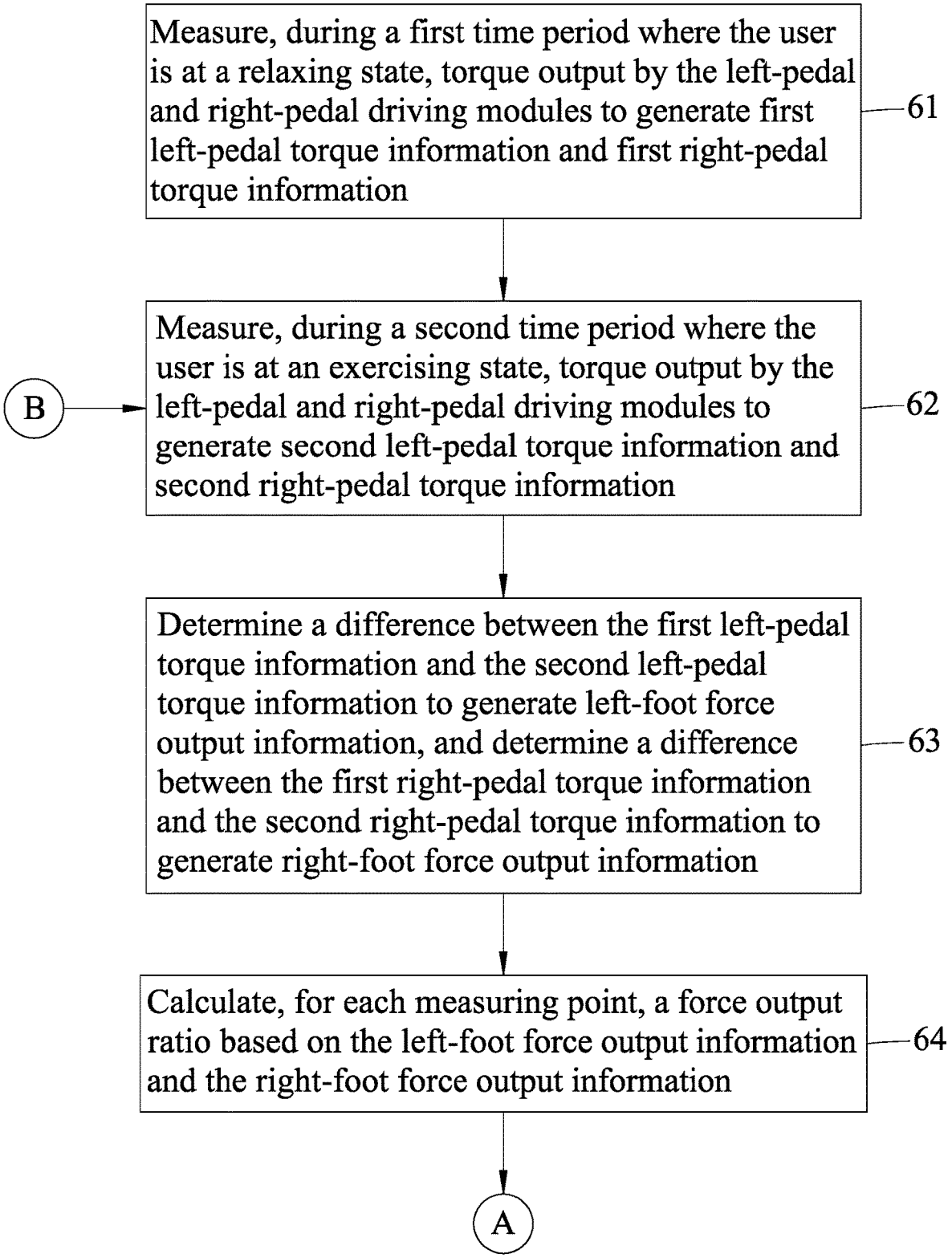
FIG. 3 is a flow chart illustrating an embodiment of steps for obtaining a force output ratio relating to forces output by the feet of the user according to this disclosure.
Figure 4A:
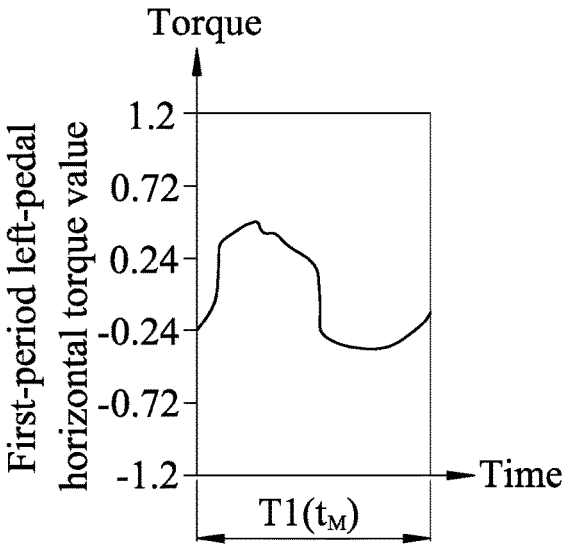
FIGS. 4A-4D show plots exemplarily illustrating torques output by the rehabilitation equipment during a first time period in which the user is at a relaxing state.
Figure 4B:
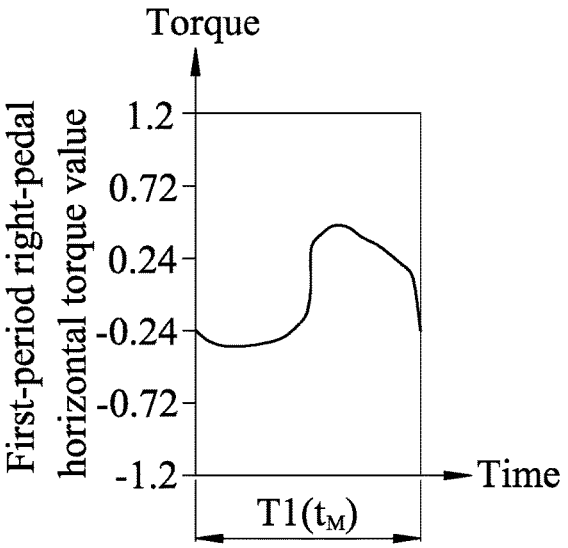
Figure 4C:
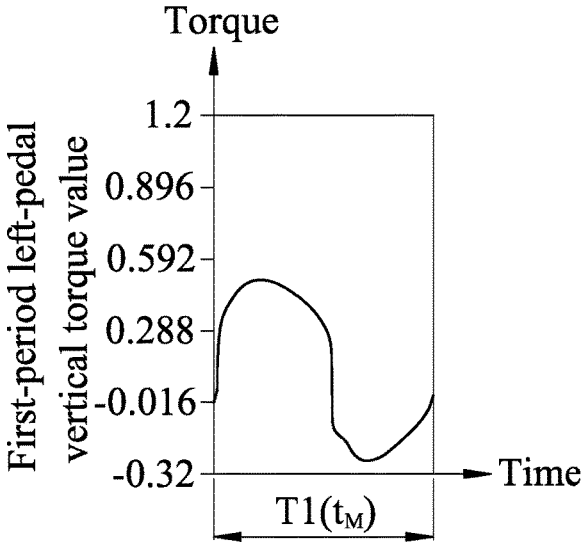
Figure 4D:
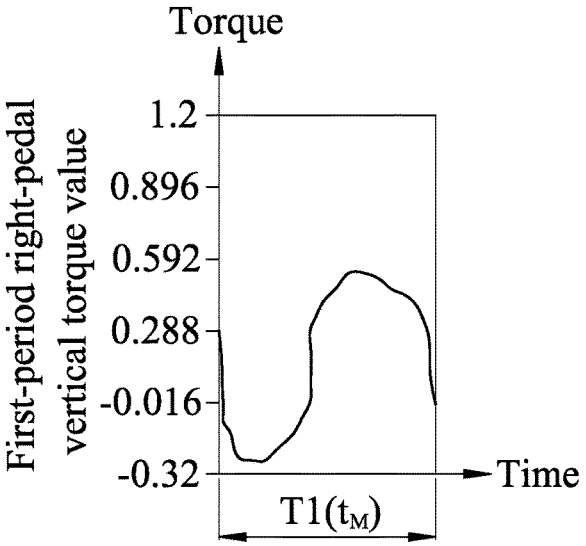
Figure 5A:
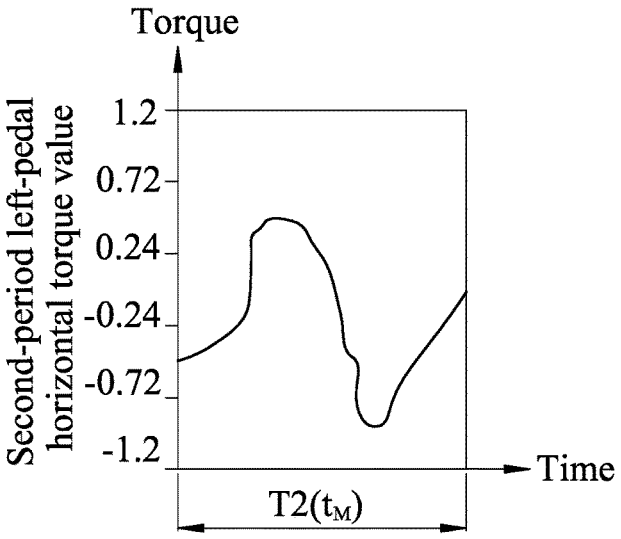
FIGS. 5A-5D show plots exemplarily illustrating torques output by the rehabilitation equipment during a second time period in which the user is at an exercising state.
Figure 5B:
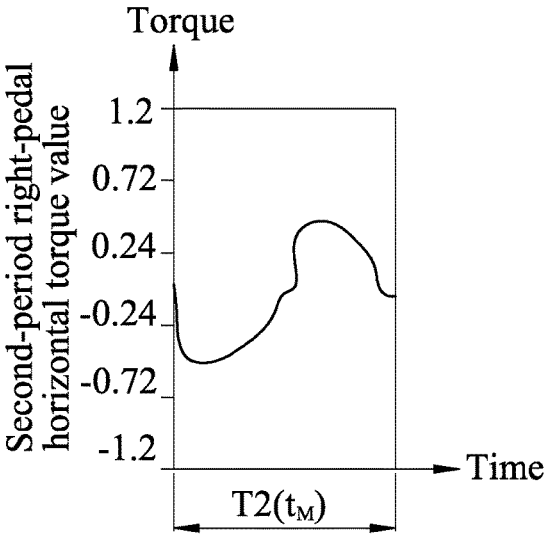
Figure 5C:
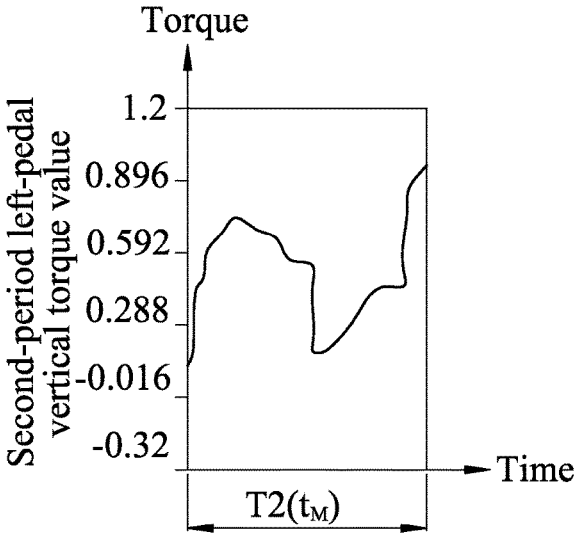
Figure 5D:
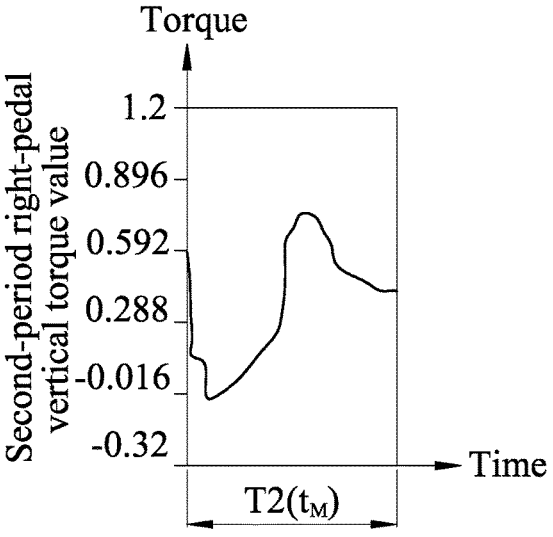
Figure 6A:
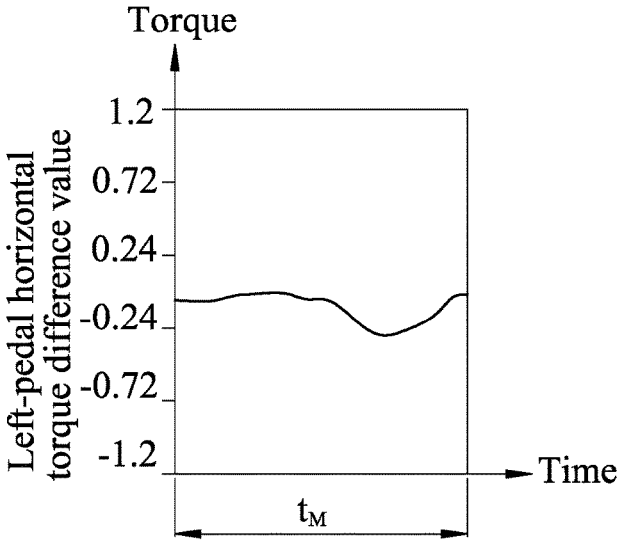
FIGS. 6A-6D show exemplarily illustrating differences of torques output by the rehabilitation equipment between those output during the first time period and those output during the second time period, which are calculated based on the plots shown in FIGS. 4A-4D and 5A-5D.
Figure 6B:
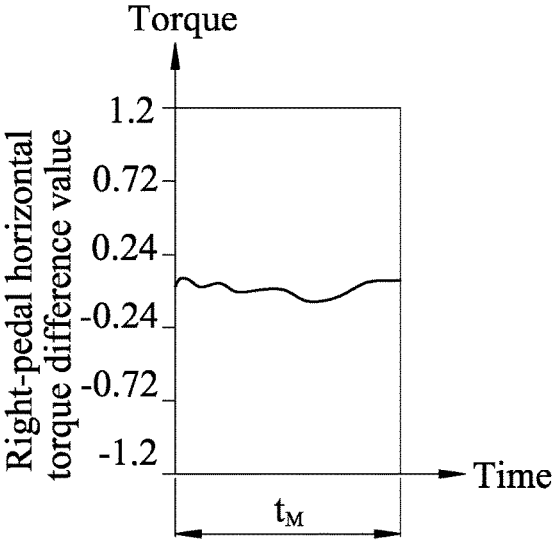
Figure 6C:
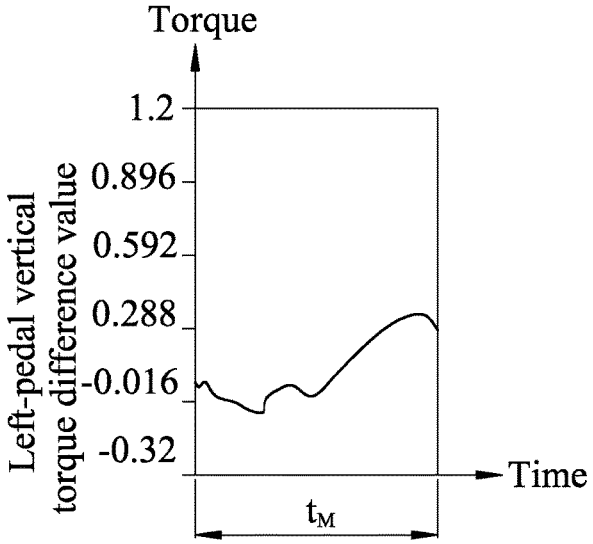
Figure 6D:
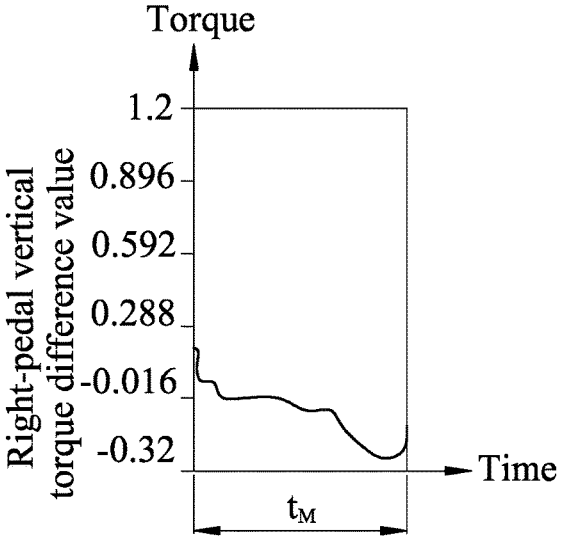

Referring to FIGS. 1 through 3, the rehabilitation equipment 100 performs steps 61 through 64 to calculate the force output information and the force output ratio in this embodiment.

In step 61, while the rehabilitation equipment 100 is operated, with the user having the left foot on the left foot pedal 1 and the right foot on the right foot pedal 2 at a relaxing state (i.e., the user does not intend to move his/her feet to take steps), to have the left-pedal driving module 11 and the right-pedal driving module 21 drive movement of the left foot pedal 1 and the right foot pedal 2, the left-pedal measuring module 12 and the right-pedal measuring module 22 measure, during a first time period which has a length equaling that of a measuring cycle, the torque output by the left-pedal driving module 11 to generate first left-pedal torque information corresponding to the first time period, and the torque output by the right-pedal driving module 21 to generate first right-pedal torque information corresponding to the first time period. In this embodiment, each of the left-pedal measuring module 12 and the right-pedal measuring module 22 may include a force transducer that is connected to the corresponding one of the left-pedal driving module 11 and the right-pedal driving module 21, and that generates an output charge or voltage proportional to the torque output by the corresponding one of the left-pedal driving module 11 and the right-pedal driving module 21 (e.g., torque outputted by the first motor 213 and the second motor 214). The first left-pedal torque information includes multiple sets of first-period left-pedal torque data respectively corresponding to a plurality of measuring points which are points in time defined within the measuring cycle, and the first right-pedal torque information includes multiple sets of first-period right-pedal torque data respectively corresponding to the measuring points. Each set of the first-period left-pedal torque data includes a first-period left-pedal horizontal torque value and a first-period left-pedal vertical torque value, and each set of the first-period right-pedal torque data includes a first-period right-pedal horizontal torque value and a first-period right-pedal vertical torque value, as shown in FIGS. 4A-4D, where T1 represents the first time period, and $t_M$ represents the length of the first time period.

In step 62, while the rehabilitation equipment 100 is operated, with the user having the left foot on the left foot pedal 1 and the right foot on the right foot pedal 2 in an exercising state (i.e., the user intends to voluntarily output forces by his/her feet in order to take steps), to have the left-pedal driving module 11 and the right-pedal driving module 21 assist the user in driving the movement of the left foot pedal 1 and the right foot pedal 2, the left-pedal measuring module 12 and the right-pedal measuring module 22 measures, during a second time period which has a length also equaling that of the measuring cycle, the torque output by the left-pedal driving module 11 to generate second left-pedal torque information corresponding to the second time period, and the torque output by the right-pedal driving module 21 to generate second right-pedal torque information corresponding to the second time period. The second left-pedal torque information includes multiple sets of second-period left-pedal torque data respectively corresponding to the measuring points, and the second right-pedal torque information includes multiple sets of second-period right-pedal torque data respectively corresponding to the measuring points. Each set of the second-period left-pedal torque data includes a second-period left-pedal horizontal torque value and a second-period left-pedal vertical torque value, and each set of the second-period right-pedal torque data includes a second-period right-pedal horizontal torque value and a second-period right-pedal vertical torque value, as shown in FIGS. 5A-5D, where T2 represents the second time period, and $t_M$ represents the length of the second time period.

In step 63, the processing module 5 determines a difference between the first left-pedal torque information and the second left-pedal torque information to generate left-foot force output information relating to a force output by the left foot of the user, and determines a difference between the first right-pedal torque information and the second right-pedal torque information to generate right-foot force output information relating to a force output by the right foot of the user. The left-foot force output information includes multiple sets of left-pedal torque difference data respectively corresponding to the measuring points, and each set of the left-pedal torque difference data relates to a difference between one set of the second-period left-pedal torque data and one set of the first-period left-pedal torque data that correspond to a respective same one of the measuring points. The right-foot force output information includes multiple sets of right-pedal torque difference data respectively corresponding to the measuring points, and each set of the right-pedal torque difference data relates to a difference between one set of the second-period right-pedal torque data and one set of the first-period right-pedal torque data that correspond to a respective same one of the measuring points. As shown in FIGS. 6A-6D, each set of the left-pedal torque difference data includes a left-pedal horizontal torque difference value and a left-pedal vertical torque difference value, and each set of the right-pedal torque difference data includes a right-pedal horizontal torque difference value and a right-pedal vertical torque difference value. In this embodiment, each set of the left-pedal torque difference data is obtained by determining a difference between the corresponding set of the first-period left-pedal torque data from the corresponding set of the second-period left-pedal torque data, and each set of the right-pedal torque difference data is obtained by determining a difference between the corresponding set of the first-period right-pedal torque data from the corresponding set of the second-period right-pedal torque data. In detail, the left-pedal horizontal torque difference value of each set of the left-pedal torque difference data is obtained by subtracting the first-period left-pedal horizontal torque value of the corresponding set of the first-period left-pedal torque data from the second-period left-pedal horizontal torque value of the corresponding set of the second-period left-pedal torque data; the left-pedal vertical torque difference value of each set of the left-pedal torque difference data is obtained by subtracting the first-period left-pedal vertical torque value of the corresponding set of the first-period left-pedal torque data from the second-period left-pedal vertical torque value of the corresponding set of the second-period left-pedal torque data; the right-pedal horizontal torque difference value of each set of the right-pedal torque difference data is obtained by subtracting the first-period right-pedal horizontal torque value of the corresponding set of the first-period right-pedal torque data from the second-period right-pedal horizontal torque value of the corresponding set of the second-period right-pedal torque data; and the right-pedal vertical torque difference value of each set of the right-pedal torque difference data is obtained by subtracting the first-period right-pedal vertical torque value of the corresponding set of the first-period right-pedal torque data from the second-period right-pedal vertical torque value of the corresponding set of the second-period right-pedal torque data.

Figure 8:
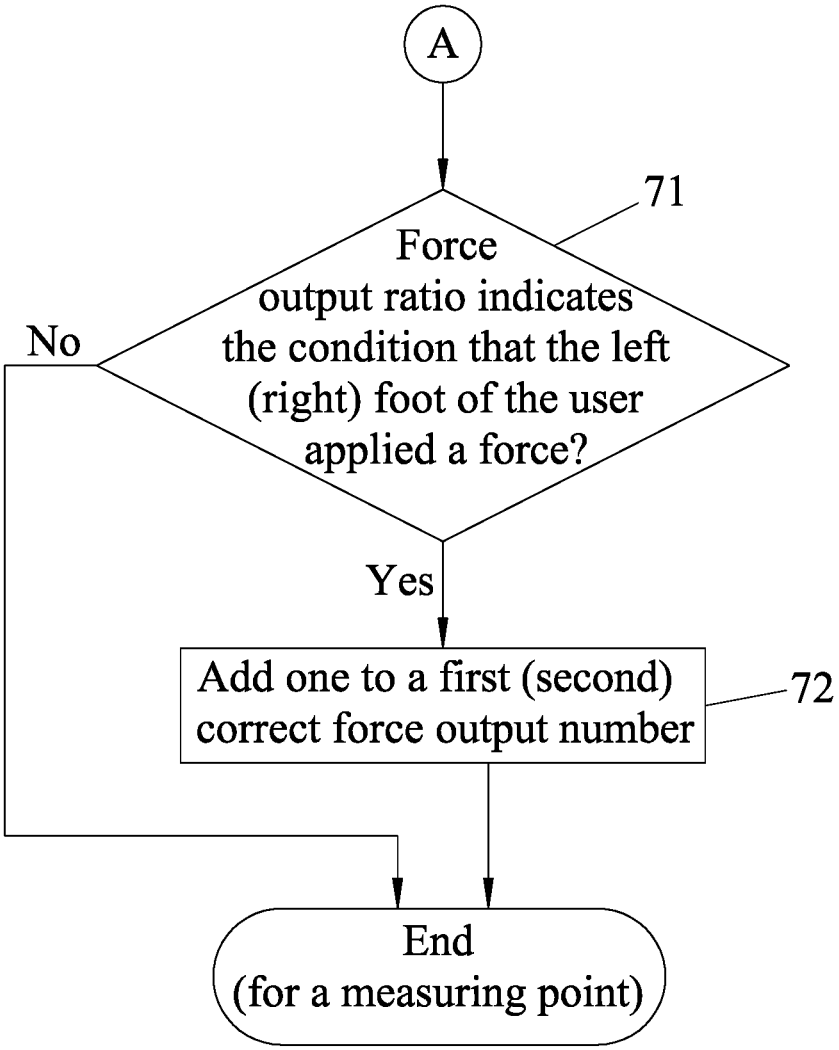
FIG. 8 is a flow chart illustrating an embodiment of steps of obtaining accuracy of force output by each of the left foot and the right foot of the user during the second time period according to this disclosure.

In step 64, the processing module 5 calculates, for each of the measuring points, a force output ratio based on the corresponding set of the left-pedal torque difference data and the corresponding set of the right-pedal torque difference data, and causes the display module 3 to display the force output ratio. For each of the measuring points, the force output ratio indicates one of a condition that the left foot of the user applied a force, a condition that the right foot of the user applied a force, and a condition that neither the left foot nor the right foot of the user applied a force. The rehabilitation equipment 100 may include a screen (not shown) to display the force output ratio for each measuring point, so the user can adjust forces output thereby according to information displayed on the screen. Then, the flow goes to step 71 (see FIG. 8, marks "A" in FIGS. 3 and 8 represent connection between step 64 and step 71).

Figure 7:
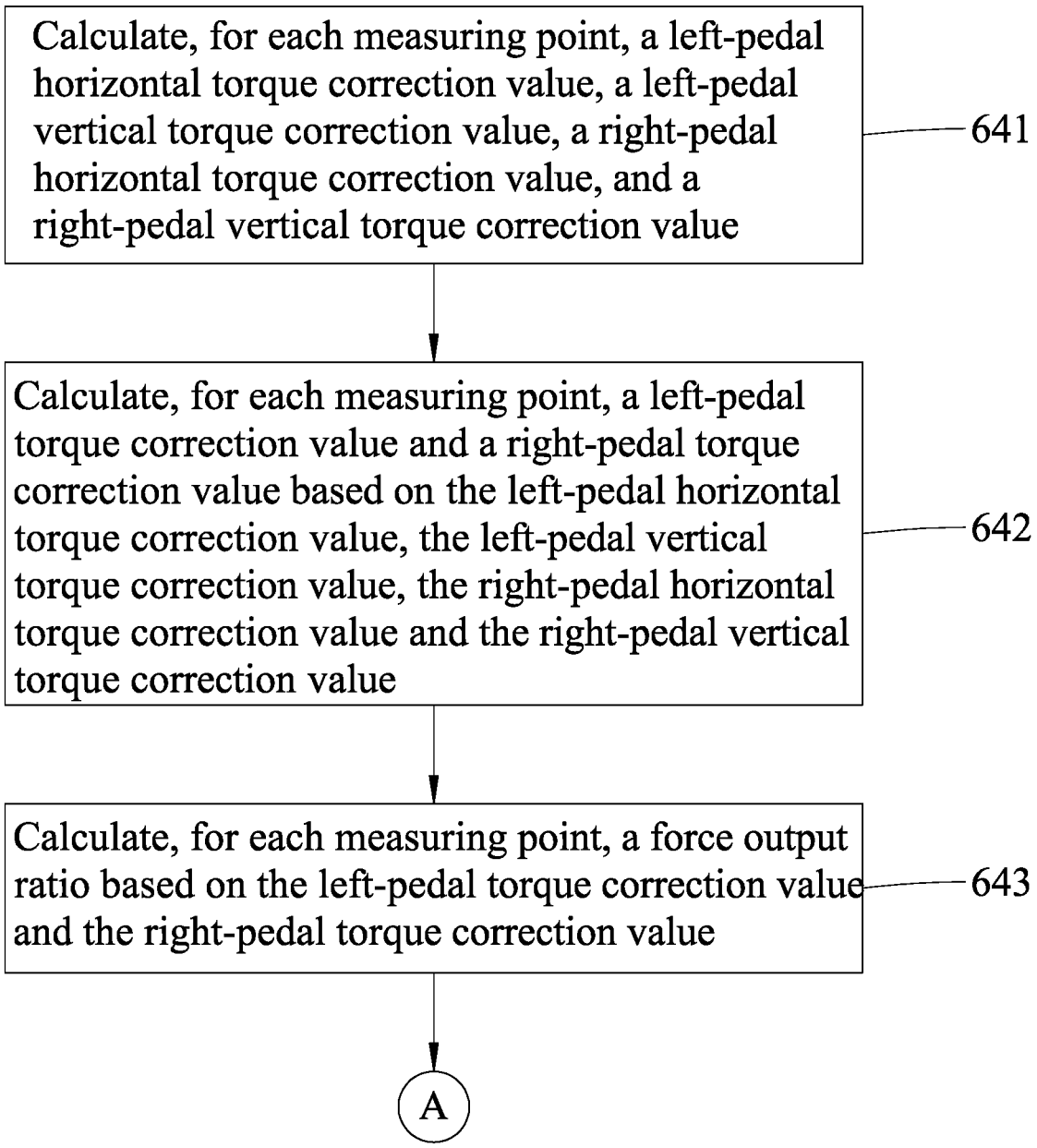
FIG. 7 is a flow chart illustrating an embodiment of detailed steps for obtaining the force output ratio.

Further referring to FIG. 7, step 64 includes sub-steps 641 through 643.

In sub-step 641, for each of the measuring points, the processing module 5 corrects/adjusts the left-pedal horizontal torque difference value that corresponds to the measuring point based on a predetermined horizontal torque reference value that corresponds to the measuring point to obtain a left-pedal horizontal torque correction value, corrects/adjusts the left-pedal vertical torque difference value that corresponds to the measuring point based on a predetermined vertical torque reference value that corresponds to the measuring point to obtain a left-pedal vertical torque correction value, corrects/adjusts the right-pedal horizontal torque difference value that corresponds to the measuring point based on the predetermined horizontal torque reference value that corresponds to the measuring point to obtain a right-pedal horizontal torque correction value, and corrects/adjusts the right-pedal vertical torque difference value that corresponds to the measuring point based on the predetermined vertical torque reference value that corresponds to the measuring point to obtain a right-pedal vertical torque correction value. It is noted that the predetermined horizontal torque reference value and the predetermined vertical torque reference value may be pre-stored in the storage module 4. The predetermined vertical torque reference value and the predetermined horizontal torque reference value may be useful in excluding the influence caused by signal noise, so as to enhance accuracy of the subsequent computation. In this embodiment, the left-pedal horizontal torque correction value is calculated according to:

$$\begin{cases} P_{1,x} = F_{1,x} - 1 & (F_{1,x} \le TH_x) \\ P_{1,x} = 1 & (F_{1,x} > TH_x) \end{cases}, \quad (1)$$

where $P_{l,x}$ represents the left-pedal horizontal torque correction value, $F_{l,x}$ represents the left-pedal horizontal torque difference value, and $TH_x$ represents the predetermined horizontal torque reference value; the left-pedal vertical torque correction value is calculated according to:

$$\begin{cases} P_{1,y} = F_{1,y} + 1 & (F_{1,y} \ge TH_y) \\ P_{1,y} = 1 & (F_{1,y} < TH_y) \end{cases}, \quad (2)$$

where $P_{l,y}$ represents the left-pedal vertical torque correction value, $F_{l,y}$ represents the left-pedal vertical torque difference value, and $TH_y$ represents the predetermined vertical torque reference value; the right-pedal horizontal torque correction value is calculated according to:

$$\begin{cases} P_{r,x} = F_{r,x} - 1 & (F_{r,x} \le TH_x) \\ P_{r,x} = 1 & (F_{r,x} > TH_x) \end{cases}, \quad (3)$$

where $P_{r,x}$ represents the right-pedal horizontal torque correction value, and $F_{r,x}$ represents the right-pedal horizontal torque difference value; and the right-pedal vertical torque correction value is calculated according to:

$$\begin{cases} P_{r,y} = F_{r,y} + 1 & (F_{r,y} \ge TH_y) \\ P_{r,y} = 1 & (F_{r,y} < TH_y) \end{cases}, \quad (4)$$

where $P_{r,y}$ represents the right-pedal vertical torque correction value, and $F_{r,y}$ represents the right-pedal vertical torque difference value. According to the aforementioned equation (1), the processing module 5 corrects/adjusts the left-pedal horizontal torque difference value by setting the left-pedal horizontal torque difference value to one to obtain the left-pedal horizontal torque correction value when the left-pedal horizontal torque difference value is greater than the predetermined horizontal torque reference value. Since the aforementioned equations (2) to (4) involve similar operations to that of equation (1), detailed explanations on correcting the left-pedal vertical torque difference value, the right-pedal horizontal torque difference value and the right-pedal vertical torque difference value are omitted herein for the sake of brevity.

In sub-step 642, the processing module 5 calculates, for each of the measuring points, a left-pedal torque correction value based on the left-pedal horizontal torque correction value and the left-pedal vertical torque correction value that correspond to the measuring point, and a right-pedal torque correction value based on the right-pedal horizontal torque correction value and the right-pedal vertical torque correction value that correspond to the measuring point. In this embodiment, the left-pedal torque correction value is calculated according to:

$$S_l = |P_{l,x}| \times |P_{l,y}| \quad (5),$$

where $S_l$ represents the left-pedal torque correction value; and the right-pedal torque correction value is calculated according to:

$$S_r = |P_{r,x}| \times |P_{r,y}| \quad (6),$$

where $S_r$ represents the right-pedal torque correction value.

In sub-step 643, the processing module 5 calculates, for each of the measuring points, the force output ratio based on the left-pedal torque correction value and the right-pedal torque correction value that correspond to the measuring point. In this embodiment, the force output ratio is calculated according to:

$$\begin{cases} R = \left(\frac{S_1}{S_r}\right) - 1 & (S_1 \geq S_r) \\ R = -\left(\frac{S_r}{S_1}\right) + 1 & (S_1 < S_r) \end{cases}, \quad (7)$$

where R represents the force output ratio. Then, the flow goes to step 71 (see FIG. 8, marks "A" in FIGS. 7 and 8 represent connection between step 643 and step 71).

After acquiring the force output ratio for each of the measuring points in step 64, the processing module 5 may assess force output accuracy for each foot of the user during the second time period. In order to perform the assessment, the storage module 4 may store predetermined left-pedal force output reference information and predetermined right-pedal force output reference information therein. The predetermined left-pedal force output reference information indicates at which one of the measuring points, among all of the measuring points in the measuring cycle, the left foot of the user should apply a force on the left pedal 1. The predetermined right-pedal force output reference information indicates at which one of the measuring points, among all of the measuring points in the measuring cycle, the right foot of the user should apply a force on the right pedal 2.

Referring to FIGS. 1, 2 and 8, in step 71, the processing module 5 determines, for each of the measuring points which are indicated by the predetermined left-pedal (right-pedal) force output reference information and at which the left (right) foot of the user should apply a force on the left pedal 1 (right pedal 2), whether the force output ratio corresponding to the measuring point indicates the condition that the left (right) foot of the user applied a force. For each of these measuring points, the flow goes to step 72 when the determination is affirmative, and terminates when otherwise.

In step 72, the processing module 5 adds one to a first (second) correct force output number, which may be stored in the storage module 4 and which may initially be zero. The flow then terminates for that measuring point.

Based on steps 71 and 72, the processing module 5 may calculate, based on the predetermined left-pedal force output reference information and the force output ratio for each of the measuring points, a first accuracy that relates to the force output by the left foot of the user during the second time period, and calculate, based on the predetermined right-pedal force output reference information and the force output ratio for each of the measuring points, a second accuracy that relates to the force output by the right foot of the user during the second time period.

Figure 9:
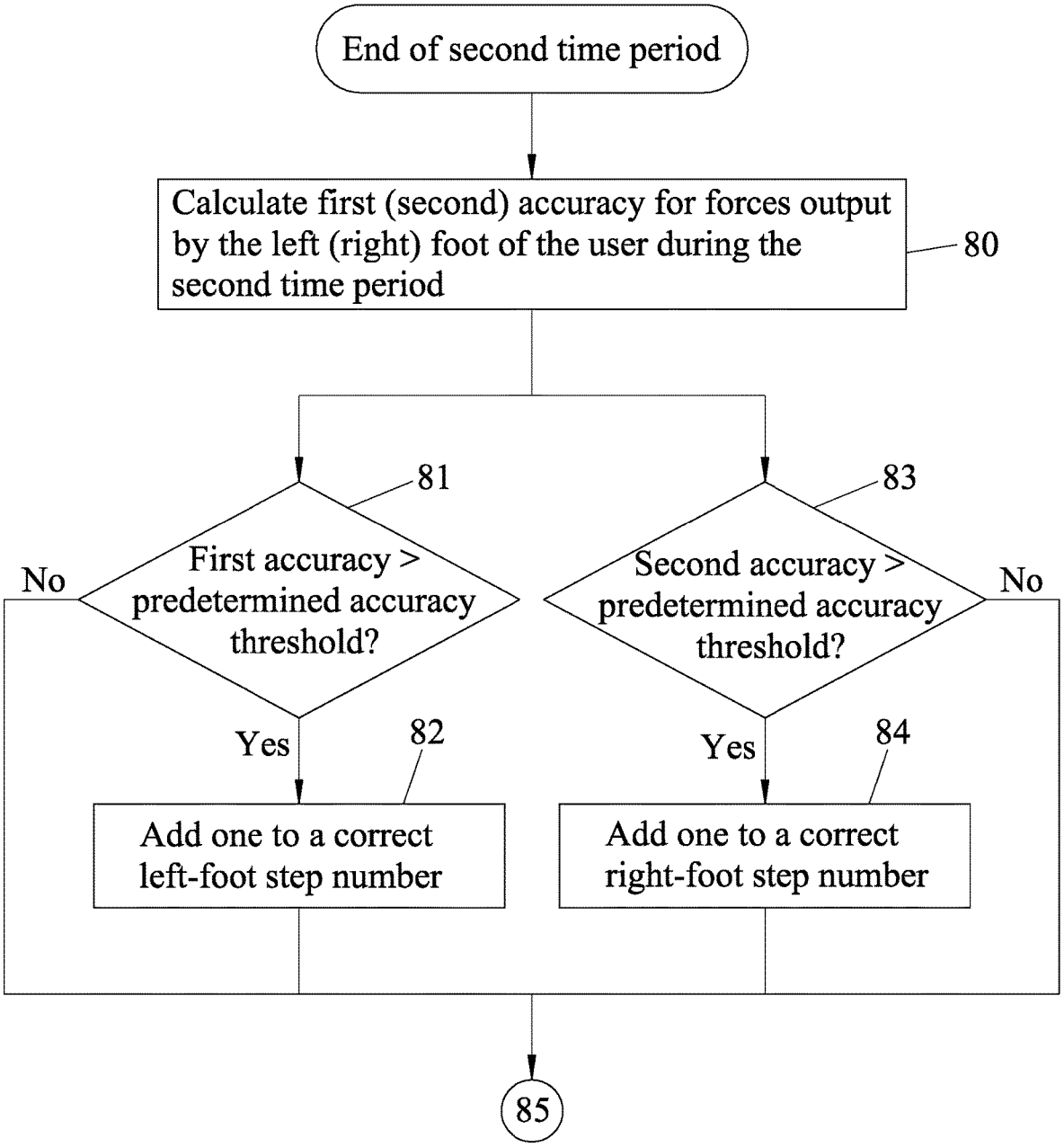
FIGS. 9 and 10 cooperatively provide a flow chart illustrating an embodiment of steps for calculating an overall step accuracy and a level of voluntary movement of the user during the rehabilitation according to this disclosure.
Figure 10:
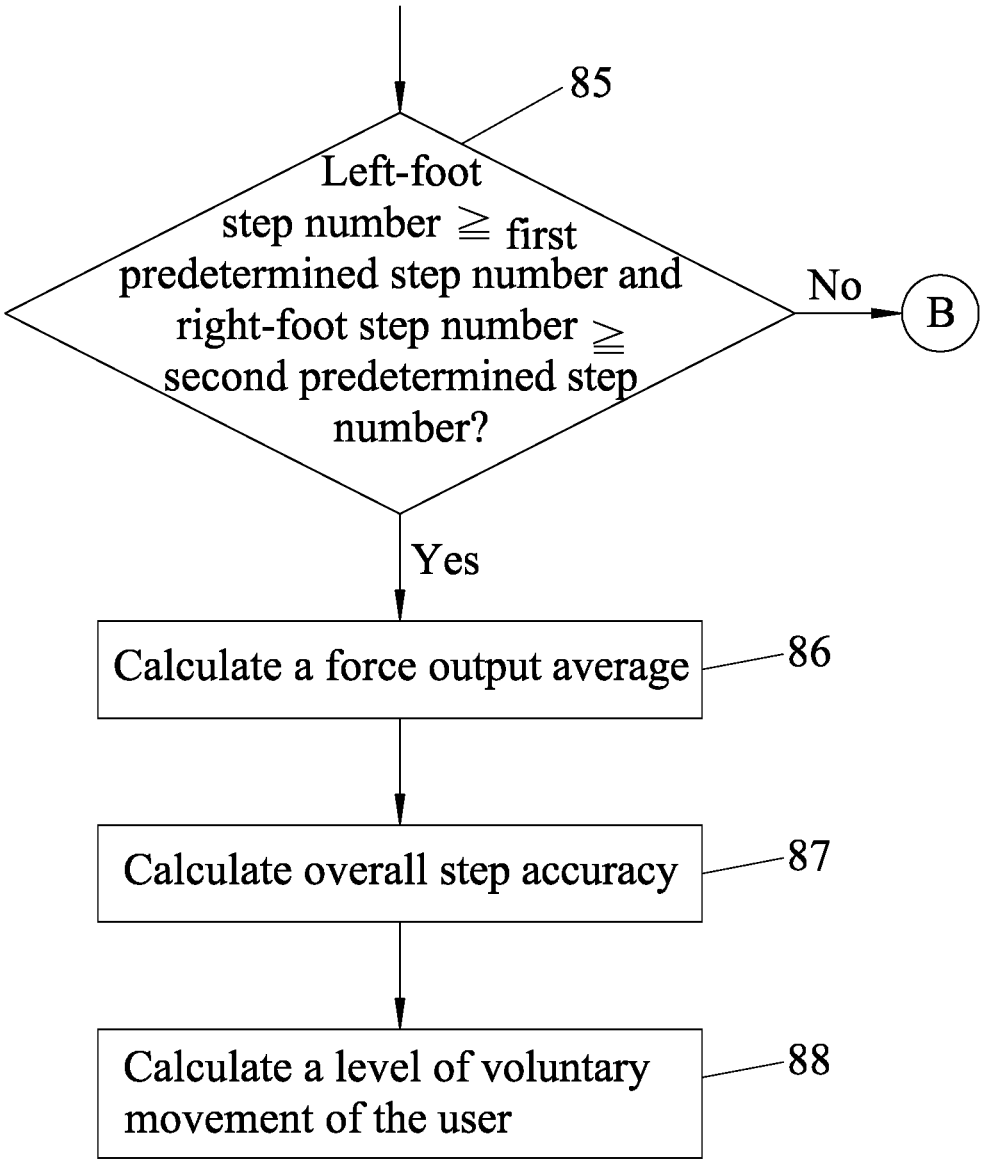

Referring to FIGS. 9 and 10, after the end of the second time period, the processing module 5 calculates the first (second) accuracy based on the first (second) correct force output number and those of the measuring points which are indicated by the predetermined left-pedal (right-pedal) force output reference information and at which the left (right) foot of the user should apply a force on the left pedal 1 (right pedal 2) (step 80).

After acquiring the first accuracy and the second accuracy during a single second time period, the processing module 5 may subsequently calculate overall step accuracy for the user during the entire rehabilitation process and assess a level of voluntary movement of the user according to steps 81 through 88.

In step 81, the processing module 5 determines whether the first accuracy is higher than a predetermined accuracy threshold, which may be stored in the storage module 4. The flow goes to step 82 when the determination is affirmative, and goes to step 85 when otherwise. In step 82, the processing module 5 adds one to a correct left-foot step number, which may be stored in the storage module 4 and which may initially be zero.

Similarly, in step 83, the processing module 5 determines whether the second accuracy is higher than the predetermined accuracy threshold. The flow goes to step 84 when the determination is affirmative, and goes to step 85 when otherwise. In step 84, the processing module 5 adds one to a correct right-foot step number, which may be stored in the storage module 4 and which may initially be zero.

In step 85, the processing module 5 determines whether a left-foot step number reaches a first predetermined step number and a right-foot step number reaches a second predetermined step number. It is noted that, in step 62, the processing module 5 may add one to each of the left-foot step number and the right-foot step number at the end of the second time period. Each of the left-foot step number and the right-foot step number may be stored in the storage module 4 and may initially be zero. The first and second predetermined step numbers may be stored in the storage module 4, and may be the same number in one embodiment. The flow goes to step 86 when the determination is affirmative, and goes back to step 62 for a next treading cycle when otherwise (see FIG. 3, marks "B" in FIGS. 10 and 3 represent connection between step 85 and step 62). In each treading cycle, the left foot of the user makes a full circle of action in taking a step, and the right foot of the user also makes a full circle of action in taking a step.

In step 86, the processing module 5 calculates a force output average based on the force output ratios corresponding to the measuring points in each treading cycle (corresponding to each repetition of the method steps 62 through 85).

In step 87, the processing module 5 calculates the overall step accuracy based on the correct left-foot step number, the correct right-foot step number, the first predetermined step number and the second predetermined step number. In this embodiment, the overall step accuracy is calculated by dividing a sum of the correct left-foot step number and the correct right-foot step number using a sum of the first predetermined step number and the second predetermined step number. It is noted that steps 86 and 87 are independent of each other, and the order of performing these two steps is not limited.

In step 88, the processing module 5 calculates a level of voluntary movement of the user based on the force output average and the overall step accuracy, and causes the display module 3 to display the level of voluntary movement. In this embodiment, the level of voluntary movement is calculated according to:

$$V_m = F_{LV} \times W_1 + Acc \times W_2 \quad (8),$$

where $V_m$ represents the level of voluntary movement, $F_{LV}$ represents the force output average, Acc represents the overall step accuracy, $W_1$ is a first predetermined weight, and $W_2$ is a second predetermined weight.

In summary, the rehabilitation equipment 100 according to this disclosure measures the torques output by the left-pedal driving module 11 and the right-pedal driving module 21 when the user is at the relaxing state and also when the user is at the exercising state, thereby obtaining information relating to the forces voluntarily output by the left foot and the right foot of the user. Then, the rehabilitation equipment 100 may determine whether the timings of the force output by the user are correct for each treading cycle (and thus also for each footstep), thereby effectively assessing the level of the voluntary movement of the user during the rehabilitation process. In addition, the display of the rehabilitation information, such as the force output ratio, the first accuracy, the second accuracy, the overall step accuracy, and the level of the voluntary movement may encourage the user to seek improvement, thereby motivating the user to return for the next rehabilitation session.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A method for assessing voluntary movement of a user during rehabilitation, comprising steps of:

A) providing a rehabilitation equipment that includes:

a left foot pedal for operation by a left foot of the user;

a left-pedal driving module to drive movement of the left foot pedal for guiding the left foot of the user to take a step;

a left-pedal measuring module mounted to the left-pedal driving module and configured to measure a torque output by the left-pedal driving module to drive movement of the left foot pedal;

a right foot pedal for operation by a right foot of the user;

a right-pedal driving module to drive movement of the right foot pedal for guiding the right foot of the user to take a step;

a right-pedal measuring module mounted to the right-pedal driving module and configured to measure a torque output by the right-pedal driving module to drive movement of the right foot pedal; and a processing module electrically coupled to the left-pedal measuring module and the right-pedal measuring module;

B) by the left-pedal measuring module and the right-pedal measuring module, measuring, during a first time period which has a length equaling that of a measuring cycle and in which both of the left foot of the user on the left foot pedal and the right foot of the user on the right foot pedal are at a relaxing state, the torque output by the left-pedal driving module to generate first left-pedal torque information corresponding to the first time period, and the torque output by the right-pedal driving module to generate first right-pedal torque information corresponding to the first time period, wherein the first left-pedal torque information includes multiple sets of first-period left-pedal torque data respectively corresponding to a plurality of measuring points which are points in time defined within the measuring cycle, and the first right-pedal torque information includes multiple sets of first-period right-pedal torque data respectively corresponding to the measuring points, and wherein each of the sets of the first-period left-pedal torque data includes a first-period left-pedal horizontal torque value and a first-period left-pedal vertical torque value, and each of the sets of the first-period right-pedal torque data includes a first-period right-pedal horizontal torque value and a first-period right-pedal vertical torque value;

C) by the left-pedal measuring module and right-pedal measuring module, measuring, during a second time period which has a length equaling that of the measuring cycle and in which both of the left foot of the user on the left foot pedal and the right foot of the user on the right foot pedal are at an exercising state, the torque output by the left-pedal driving module to generate second left-pedal torque information corresponding to the second time period, and the torque output by the right-pedal driving module to generate second right-pedal torque information corresponding to the second time period, wherein the second left-pedal torque information includes multiple sets of second-period left-pedal torque data respectively corresponding to the measuring points, and the second right-pedal torque information includes multiple sets of second-period right-pedal torque data respectively corresponding to the measuring points, and wherein each of the sets of the second-period left-pedal torque data includes a second-period left-pedal horizontal torque value and a second-period left-pedal vertical torque value, and each of the sets of the second-period right-pedal torque data includes a second-period right-pedal horizontal torque value and a second-period right-pedal vertical torque value;

D) by the processing module, determining a difference between the first left-pedal torque information and the second left-pedal torque information to generate left-foot force output information relating to a force output by the left foot of the user, and determining a difference between the first right-pedal torque information and the second right-pedal torque information to generate right-foot force output information relating to a force output by the right foot of the user, wherein the left-foot force output information includes multiple sets of left-pedal torque difference data respectively corresponding to the measuring points, each of the sets of the left-pedal torque difference data relating to a difference between one of the sets of the second-period left-pedal torque data and one of the sets of the first-period left-pedal torque data that correspond to a respective same one of the measuring points, wherein each of the sets of the left-pedal torque difference data includes a left-pedal horizontal torque difference value which is a difference between the first-period left-pedal horizontal torque value of the corresponding one of the sets of the first-period left-pedal torque data and the second-period left-pedal horizontal torque value of the corresponding one of the sets of the second-period left-pedal torque data, and a left-pedal vertical torque difference value which is a difference between the first-period left-pedal vertical torque value of the corresponding one of the sets of the first-period left-pedal torque data and the second-period left-pedal vertical torque value of the corresponding one of the sets of the second-period left-pedal torque data, wherein the right-foot force output information includes multiple sets of right-pedal torque difference data respectively corresponding to the measuring points, each of the sets of the right-pedal torque difference data relating to a difference between one of the sets of the second-period right-pedal torque data and one of the sets of the first-period right-pedal torque data that correspond to a respective same one of the measuring points, and wherein each of the right-pedal torque difference data includes a right-pedal horizontal torque difference value which is a difference between the first-period right-pedal horizontal torque value of the corresponding one of the sets of the first-period right-pedal torque data and the second-period right-pedal horizontal torque value of the corresponding one of the sets of the second-period right-pedal torque data, and a right-pedal vertical torque difference value which is a difference between the first-period right-pedal vertical torque value of the corresponding one of the sets of the first-period right-pedal torque data and the second-period right-pedal vertical torque value of the corresponding one of the sets of the second-period right-pedal torque data;

E) by the processing module, for each of the measuring points, correcting the left-pedal horizontal torque difference value that corresponds to the measuring point based on a predetermined horizontal torque reference value that corresponds to the measuring point to obtain a left-pedal horizontal torque correction value, correcting the left-pedal vertical torque difference value that corresponds to the measuring point based on a predetermined vertical torque reference value that corresponds to the measuring point to obtain a left-pedal vertical torque correction value, correcting the right-pedal horizontal torque difference value that corresponds to the measuring point based on the predetermined horizontal torque reference value that corresponds to the measuring point to obtain a right-pedal horizontal torque correction value, and correcting the right-pedal vertical torque difference value that corresponds to the measuring point based on the predetermined vertical torque reference value that corresponds to the measuring point to obtain a right-pedal vertical torque correction value;

F) by the processing module, calculating, for each of the measuring points, a left-pedal torque correction value based on the left-pedal horizontal torque correction value and the left-pedal vertical torque correction value that correspond to the measuring point, and a right-pedal torque correction value based on the right-pedal horizontal torque correction value and the right-pedal vertical torque correction value that correspond to the measuring point; and G) by the processing module, calculating, for each of the measuring points, a force output ratio based on the left-pedal torque correction value and the right-pedal torque correction value that correspond to the measuring point;

wherein, for each of the measuring points, the force output ratio indicates one of a condition that the left foot of the user applied a force, a condition that the right foot of the user applied a force, and a condition that neither the left foot nor the right foot of the user applied a force; and wherein the force output ratio is calculated according to:

$$R = \left(\frac{S_l}{S_r}\right) - 1 \text{ when } (S_l \geq S_r)$$

$$R = -\left(\frac{S_r}{S_l}\right) + 1 \text{ when } (S_l < S_r)$$

where R represents the force output ratio, $S_r$ represents the right-pedal torque correction value, and $S_l$ represents the left-pedal torque correction value.

2. The method of claim 1, wherein the rehabilitation equipment further includes a storage module that is electrically connected to the processing module and that stores predetermined left-pedal force output reference information that indicates at which one of the measuring points, among all of the measuring points in the measuring cycle, the left foot of the user should apply a force on the left pedal, and predetermined right-pedal force output reference information that indicates at which one of the measuring points, among all of the measuring points in the measuring cycle, the right foot of the user should apply a force on the right pedal; said method further comprising, after the step G), a step of H) calculating, by the processing module, a first accuracy relating to the force output by the left foot of the user based on the predetermined left-pedal force output reference information and the force output ratio for each of the measuring points, and a second accuracy relating to the force output by the right foot of the user based on the predetermined right-pedal force output reference information and the force output ratio for each of the measuring points.

3. The method of claim 2, wherein the calculating the first accuracy includes: determining, for each of those of the measuring points which are indicated by the predetermined left-pedal force output reference information and at which the left foot of the user should apply a force on the left pedal, whether the force output ratio corresponding to the measuring point indicates the condition that the left foot of the user applied a force;

upon determining, for each of those of the measuring points which are indicated by the predetermined left-pedal force output reference information and at which the left foot of the user should apply a force on the left pedal, that the force output ratio corresponding to the measuring point indicates the condition that the left foot of the user applied a force, adding one to a first correct force output number; and calculating the first accuracy based on the first correct force output number and a number of those of the measuring points which are indicated by the predetermined left-pedal force output reference information and at which the left foot of the user should apply a force on the left pedal; and wherein the calculating the second accuracy includes:

determining, for each of those of the measuring points which are indicated by the predetermined right-pedal force output reference information and at which the right foot of the user should apply a force on the right pedal, whether the force output ratio corresponding to the measuring point indicates the condition that the right foot of the user applied a force;

upon determining, for each of those of the measuring points which are indicated by the predetermined right-pedal force output reference information and at which the right foot of the user should apply a force on the right pedal, that the force output ratio corresponding to the measuring point indicates the condition that the right foot of the user applied a force, adding one to a second correct force output number; and calculating the second accuracy based on the second correct force output number and those of the measuring points which are indicated by the predetermined right-pedal force output reference information and at which the right foot of the user should apply a force on the right pedal.

4. The method of claim 3, further comprising, after the step H), steps of:

I) determining whether the first accuracy is higher than an accuracy threshold;

J) upon determining that the first accuracy is higher than the accuracy threshold, adding one to a correct left-foot step number;

K) determining whether the second accuracy is higher than the accuracy threshold; and L) upon determining that the second accuracy is higher than the accuracy threshold, adding one to a correct right-foot step number.

5. The method of claim 4, wherein the step C) further includes adding one to each of a left-foot step number and a right-foot step number, said method further comprising steps of:

M) repeating the steps C) through L) until the left-foot step number reaches a first predetermined step number and the right-foot step number reaches a second predetermined step number;

N) calculating, by the processing module, a force output average based on the force output ratios corresponding to the measuring points;

O) calculating, by the processing module, an overall step accuracy based on the correct left-foot step number, the correct right-foot step number, the first predetermined step number and the second predetermined step number; and P) calculating, by the processing module, a level of voluntary movement of the user based on the force output average and the overall step accuracy.

6. A rehabilitation equipment comprising:

a left foot pedal for operation by a left foot of a user;

a left-pedal driving module to drive movement of said left foot pedal for guiding the left foot of the user to take a step;

a right foot pedal for operation by a right foot of the user;

a right-pedal driving module to drive movement of said right foot pedal for guiding the right foot of the user to take a step;

a left-pedal measuring module mounted to said left-pedal driving module, and used to measure, during a first time period which has a length equaling that of a measuring cycle and in which both of the left foot of the user on said left foot pedal and the right foot of the user on said right foot pedal are at a relaxing state, a torque output by said left-pedal driving module to generate first left-pedal torque information corresponding to the first time period, and to measure, during a second time period which has a length equaling that of the measuring cycle and in which both of the left foot of the user on said left foot pedal and the right foot of the user on said right foot pedal are at an exercising state, a torque output by said left-pedal driving module to generate second left-pedal torque information corresponding to the second time period;

a right-pedal measuring module mounted to said right-pedal driving module, and used to measure, during the first time period, a torque output by said right-pedal driving module to generate first right-pedal torque information corresponding to the first time period, and to measure, during the second time period, a torque output by said right-pedal driving module to generate second right-pedal torque information corresponding to the second time period; and a processing module electrically connected to said left-pedal measuring module and said right-pedal measuring module for receiving the first left-pedal torque information, the second left-pedal torque information, the first right-pedal torque information, and the second right-pedal torque information, wherein the first left-pedal torque information includes multiple sets of first-period left-pedal torque data respectively corresponding to a plurality of measuring points which are points in time defined within the measuring cycle, and the first right-pedal torque information includes multiple sets of first-period right-pedal torque data respectively corresponding to the measuring points, wherein each of the sets of the first-period left-pedal torque data includes a first-period left-pedal horizontal torque value and a first-period left-pedal vertical torque value, and each of the sets of the first-period right-pedal torque data includes a first-period right-pedal horizontal torque value and a first-period right-pedal vertical torque value, wherein the second left-pedal torque information includes multiple sets of second-period left-pedal torque data respectively corresponding to the measuring points, and the second right-pedal torque information includes multiple sets of second-period right-pedal torque data respectively corresponding to the measuring points, wherein each of the sets of the second-period left-pedal torque data includes a second-period left-pedal horizontal torque value and a second-period left-pedal vertical torque value, and each of the sets of the second-period right-pedal torque data includes a second-period right-pedal horizontal torque value and a second-period right-pedal vertical torque value, wherein the processing module is configured to determine a difference between the first left-pedal torque information and the second left-pedal torque information to generate left-foot force output information relating to a force output by the left foot of the user, and determine a difference between the first right-pedal torque information and the second right-pedal torque information to generate right-foot force output information relating to a force output by the right foot of the user, wherein the left-foot force output information includes multiple sets of left-pedal torque difference data respectively corresponding to the measuring points, each of the sets of the left-pedal torque difference data relating to a difference between one of the sets of the second-period left-pedal torque data and one of the sets of the first-period left-pedal torque data that correspond to a respective same one of the measuring points, wherein each of the sets of the left-pedal torque difference data includes a left-pedal horizontal torque difference value which is a difference between the first-period left-pedal horizontal torque value of the corresponding one of the sets of the first-period left-pedal torque data and the second-period left-pedal horizontal torque value of the corresponding one of the sets of the second-period left-pedal torque data, and a left-pedal vertical torque difference value which is a difference between the first-period left-pedal vertical torque value of the corresponding one of the sets of the first-period left-pedal torque data and the second-period left-pedal vertical torque value of the corresponding one of the sets of the second-period left-pedal torque data, wherein the right-foot force output information includes multiple sets of right-pedal torque difference data respectively corresponding to the measuring points, each of the sets of the right-pedal torque difference data relating to a difference between one of the sets of the second-period right-pedal torque data and one of the sets of the first-period right-pedal torque data that correspond to a respective same one of the measuring points, wherein each of the right-pedal torque difference data includes a right-pedal horizontal torque difference value which is a difference between the first-period right-pedal horizontal torque value of the corresponding one of the sets of the first-period right-pedal torque data and the second-period right-pedal horizontal torque value of the corresponding one of the sets of the second-period right-pedal torque data, and a right-pedal vertical torque difference value which is a difference between the first-period right-pedal vertical torque value of the corresponding one of the sets of the first-period right-pedal torque data and the second-period right-pedal vertical torque value of the corresponding one of the sets of the second-period right-pedal torque data, wherein the processing module is further configured to, for each of the measuring points, correct the left-pedal horizontal torque difference value that corresponds to the measuring point based on a predetermined horizontal torque reference value that corresponds to the measuring point to obtain a left-pedal horizontal torque correction value, correct the left-pedal vertical torque difference value that corresponds to the measuring point based on a predetermined vertical torque reference value that corresponds to the measuring point to obtain a left-pedal vertical torque correction value, correct the right-pedal horizontal torque difference value that corresponds to the measuring point based on the predetermined horizontal torque reference value that corresponds to the measuring point to obtain a right-pedal horizontal torque correction value, and correct the right-pedal vertical torque difference value that corresponds to the measuring point based on the predetermined vertical torque reference value that corresponds to the measuring point to obtain a right-pedal vertical torque correction value, wherein the processing module is further configured to calculate, for each of the measuring points, a left-pedal torque correction value based on the left-pedal horizontal torque correction value and the left-pedal vertical torque correction value that correspond to the measuring point, and a right-pedal torque correction value based on the right-pedal horizontal torque correction value and the right-pedal vertical torque correction value that correspond to the measuring point, wherein the processing module is further configured to calculate, for each of the measuring points, a force output ratio based on the left-pedal torque correction value and the right-pedal torque correction value that correspond to the measuring point, wherein, for each of the measuring points, the force output ratio indicates one of a condition that the left foot of the user applied a force, a condition that the right foot of the user applied a force, and a condition that neither the left foot nor the right foot of the user applied a force, and wherein the force output ratio is calculated according to:

$$R = \left(\frac{S_l}{S_r}\right) - 1 \text{ when } (S_l \geq S_r)$$

$$R = -\left(\frac{S_r}{S_l}\right) + 1 \text{ when } (S_l < S_r)$$

where R represents the force output ratio, $S_r$ represents the right-pedal torque correction value, and $S_l$ represents the left-pedal torque correction value.

* * * * *